United States Patent [19]

Okuda

[11] Patent Number: 4,982,717

[45] Date of Patent: Jan. 8, 1991

[54] IGNITION SYSTEM FOR AN ENGINE WITH A REVERSE-ROTATION PREVENTING FUNCTION

[75] Inventor: Hiroshi Okuda, Himeji, Japan

[73] Assignee: Mitsubishi Denki Kabushiki Kaisha, Tokyo, Japan

[21] Appl. No.: 493,660

[22] Filed: Mar. 15, 1990

[51] Int. Cl.[5] ..... F02P 11/00

[52] U.S. Cl. ..... 123/603

[58] Field of Search ..... 123/603, 631

[56] References Cited

U.S. PATENT DOCUMENTS 4,244,337 1/1981 Asai ..... 123/603

4,651,705 3/1987 Kinoshita ..... 123/603

FOREIGN PATENT DOCUMENTS 51-9084 3/1976 Japan .

59-134378 8/1984 Japan ..... 123/603

*Primary Examiner*—Andrew M. Dolinar

*Attorney, Agent, or Firm*—Sughrue, Mion, Zinn, Macpeak and Seas

[57] ABSTRACT

A novel and improved ignition system for an engine with a reverse-rotation preventing function capable of ensuring a proper engine operation over the entire operating range of the engine, particularly during the high-speed rotation thereof. The ignition system comprises a generator coil for generating an alternating current output in synchronism with the rotation of the engine; an ignition circuit connected to receive the alternating current output of the generator coil for producing a high voltage for ignition; a reverse-rotation preventing circuit operable in response to the output of a predetermined polarity of the generator coil to prevent the operation of the ignition circuit as along as the predetermined polarity of the generator output remains unchanged; an engine-rotation sensing circuit for sensing the number of revolutions per minute of the engine; and a disabling circuit for disabling the reverse-rotation preventing circuit when the number of revolutions per minute of the engine as sensed by the engine-rotation sensing circuit exceeds a predetermined level.

5 Claims, 3 Drawing Sheets

IGNITION SYSTEM FOR AN ENGINE WITH A REVERSE-ROTATION PREVENTING FUNCTION

BACKGROUND OF THE INVENTION

This invention relates to an ignition system for an engine which is capable of preventing the reverse rotation of the engine at high rotational speeds thereof.

FIG. 2 illustrates the schematic circuit arrangement of a conventional ignition system for an engine. The ignition system as illustrated comprises a generator coil 1 of an unillustrated magneto generator which is driven by an unillustrated engine to generate an alternating output power in synchronism with the rotation of the engine, a rectifier diode 2 for rectifying the alternating output power of the generator coil 1, a capacitor 3 which is charged by the output of the generator coil 1 rectified by the rectifier diode 2, a signal coil 4 mounted on the magneto generator for generating an alternating output current in synchronism with the engine rotation, the signal coil 4 generating an ignition signal in correspondence with an ignition timing of the engine, a rectifier diode 5 for rectifying the alternating output current of the signal coil 4, a resistor 6 limiting the rectified output current of the signal coil 4 an ignition coil 7 having a primary side coupled to the capacitor 3 and a secondary side coupled to a spark plug 11, a thyrister 8 having a switching gate connected to receive the ignition signal of the signal coil 4 in a manner such that it is made conductive upon receipt of the ignition signal of the signal coil 4 through the rectifier 5 and the resistor 6 to thereby discharge the accumulated charge of the capacitor 3 to the primary side of the ignition coil 7 at an appropriate ignition timing, a reverse-rotation preventing circuit 9 including a resistor 9*a*, a diode 9*b* and a transistor 9*c* connected with each other in the manner as shown in FIG. 3, and having an input terminal coupled to a conductor connecting the generator coil 1 and the rectifier diode 2 and having an output terminal coupled to the switching gate of the thyrister 8, a diode 10 having an anode coupled to a conductor connecting the capacitor 3 and the primary side of the ignition coil 7 and having a grounded cathode, a spark plug 11 coupled to the secondary side of the ignition coil 7, and an ignition timing determining circuit 13 having one terminal coupled through a diode 12 to a conductor connecting the signal coil 4 and the rectifier diode 5 and the other terminal coupled to a conductor connecting the resistor 6 and the switching gate of the thyrister 8. Specifically, the reverse-rotation preventing circuit 9 is constructed such that the transistor 9*c* has a collector coupled to the switching gate of the thyrister 8 , and emitter grounded, and a base coupled through the resistor 9*a* to the conductor connecting the generator coil 1 and the rectifier diode 2 and at the same time to the cathode of the diode 9*b* which is grounded at its anode.

FIGS. 3(*a*) through 3(*d*) are waveform diagrams showing the operation of the ignition system of FIG. 2. FIG. 3(*a*) shows the alternating output current of a sinusoidal waveform generated by the generator coil 1 when the engine rotates in the forward direction, the solid line and the phantom line being at low and high speeds, respectively; FIG. 3(*b*) shows the ignition reference signal produced by the signal coil 4 when the engine rotates in the forward direction, the ignition reference signal having positive sharp pulses which correspond to ignition timings at low speeds of the engine and negative sharp pulses which correspond to maximum advanced ignition timings; FIG. 3(*c*) shows the alternating output current generated by the generator coil 1 when the engine rotates in the reverse direction, the solid line and the phantom line being at low and high speeds, respectively; and FIG. 3(*d*) shows the ignition reference signal produced by the signal coil 4 when the engine rotates in the reverse direction.

The operation of the conventional ignition system as constructed above will now be described in detail.

First, the case in which the engine rotates at low speeds, i.e., the number of revolutions per minute of the engine is less than a predetermined level, will be described. In this case, as the engine rotates in the forward rotation, the generator coil 1 produces an alternating current having a sinusoidal waveform as illustrated by the solid line in FIG. 3(*a*). Under the action of the rectifier diode 2, only the positive components of the alternating current of the generator coil 1 are passed to the capacitor 3. Based on the ignition signal produced by the signal coil 4, as illustrated in FIG. 3(*b*), the ignition timing determining circuit 13 operates to calculate an appropriate ignition timing and produce an ignition timing control signal at an appropriate crank angle of the engine. As is well known in the art, the ignition timing is generally advanced as the rotational speed of the engine increases. In this connection, it is to be noted that the ignition timing determining circuit 13 itself is well known in the art and hence the detailed description thereof is omitted. One example of such an ignition timing determinig circuit 13 is disclosed in Japanese Patent Publicatio No. 58-53194. The ignition timing determining circuit 13 produces an ignition timing control signal at a certain crank angle between the normal (low-speed) ignition timing and the maximum advanced ignition timing which correspond to the adjacent positive and negative pulses of the ignition reference signal produced by the signal coil 4. Thus, as clearly seen from FIGS. 3(*a*) and 3(*b*), when the ignition timing control signal is produced, the output of the generator coil 1 is negative and the transistor 9*c* of the reverse-rotation preventing circuit 9 is thus held non-conductive so that when the ignition timing control signal is imposed upon the switching gate of the thyrister 8, it makes the thyrister 8 conductive, thereby causing the capacitor 3 to discharge. As a result, a current flows through the primary side of the ignition coil 7 whereby a high voltage is induced at a secondary side of the ignition coil 7, causing the spark plug 11 to generate a spark.

On the other hand, when the engine rotates in the reverse direction at low speeds, the generator coil 1 produces an alternating current of a sinusoidal waveform, as illustrated by the solid line in FIG. 3(*c*), which is in a reversed relationship in phase with that (indicated by the solid line in FIG. 3(*a*)) produced during the forward engine rotation at low speeds. As is in the forward rotation of the engine, the ignition timing determining circuit 13 calculates and produces an ignition timing control signal, based on an ignition reference signal (see FIG. 3(*d*)) generated by the signal coil 4, at a certain crank angle between the adjacent negative and positive pulses of the ignition reference signal. As seen from FIGS. 3(*c*) and 3(*d*), when such an ignition timing control signal is produced, the alternating output current of the generator coil 1 has the positive polarity and hence is supplied through the resistor 9*a* of the reverse-rotation preventing circuit 9 to the base of the transistor 9*c*, making it conductive. As a result, the ignition timing control signal is shunted through the now conductive transistor 9c to ground and hence is not imposed upon the switching gate of the thyrister 8. Thus, the thyrister 8 is held non-conductive so that the capacitor 3 does not discharge. As a result, there is no spark generated by the spark plug 11 and the reverse rotation of the engine is thus prevented.

Next, the operation of the engine at high rotational speeds will be described.

In this case, as the forward rotational speed of the engine increases, the alternating output current produced by the generator coil 1 shifts or delays in phase mainly due to the increasing effect of coil inductance, as clearly shown by the phantom line in FIG. 3(*a*). When the rotational speed of the engine exceeds a prescribed level, the ignition timing determining circuit 13 produces, based upon an ignition reference signal generated by the signal coil 4, an ignition timing control signal substantially near or at the maximum advanced crank angle which corresponds to the location of negative pulses of the ignition signal of the signal coil 4. At this time, the alternating output current of the generator coil 1 has the positive polarity, as clearly seen from FIGS. 3(*a*) and 3(*b*), so that a current is supplied through resistor 9a to the base of the transistor 9c of the reverse-rotation preventing circuit 9. As a result, the transistor 9c is made conductive and thus the ignition timing control signal produced by the ignition timing control circuit 13 is shunted through the now conductive transistor 9c to ground, holding the thyrister 8 non-conductive. Thus, no sparking takes place at the spark plug 11 so that the operation of the engine is stopped.

On the other hand, in cases where the engine rotates in the reverse direction at high rotational speeds, the alternating current produced by the generator coil 1 takes an output waveform, as illustrated by the phantom line in FIG. 3(*c*), which is the reverse in phase of that produced during the forward rotation of the engine. In this state, the ignition timing determining circuit 13 produces an ignition timing control signal at a certain crank angle substantially corresponding to the negative pulses of the ignition signal of the signal coil 4. As can be seen from FIGS. 3(*c*) and 3(*d*), when such an ignition timing control signal is produced, the alternating output current of the generator coil 1 has the negative polarity so that no positive current is supplied to the base of the transistor 9c of the reverse-rotation preventing circuit 9. As a result, the transistor 9c is held non-conductive so that the ignition timing control signal produced by the ignition timing control circuit 13 is imposed upon the switching gate of the thyrister 8, making it conductive. Thus, the capacitor 3 charged by the output current of the generator coil 1 discharges through the now conductive thyrister 8, causing a current to flow through the primary side of the ignition coil 7. Accordingly, a high voltage is induced at the secondary side of the ignition coil 7 whereby the spark plug 11 generates a spark, making the engine continuously rotate in the reverse direction at high speeds.

With the above-described conventional ignition system, however, there arises the problem that during the high-speed rotation of the engine, the forward rotation of the engine is stopped whereas the reverse rotation of the engine is permitted. Thus, the conventional ignition system is not feasible and useful particularly in the high-speed rotation range.

SUMMARY OF THE INVENTION

Accordingly, the present invention is intended to obviate the above mentioned problem of the prior art and has for its object to provide a novel and improved ignition system for an engine which is able to ensure a proper engine operation over the entire operating range of the engine, particularly during the high-speed rotation thereof.

In order to achieve the above object, according to the present invention, there is provided an ignition system for an engine with a reverse-rotation preventing function the ignition system comprising:

a generator coil for generating an alternating current output in synchronism with the rotation of the engine;

an ignition circuit connected to receive the alternating current output of the generator coil for producing a high voltage for ignition;

a reverse-rotation preventing circuit operable in response to the output of a predetermined polarity of the generator coil to prevent the operation of the ignition circuit as long as the predetermined polarity of the generator output remains unchanged;

an engine-rotation sensing circuit for sensing the number of revolutions per minute of the engine; and a disabling circuit for disabling the reverse-rotation preventing circuit when the number of revolutions per minute of the engine as sensed by the engine-rotation sensing circuit exceeds a predetermined level.

The above and other objects, features and advantages of the present invention will become apparent from the following detailed description of a presently preferred embodiment of the invention taken in conjunction with the accompanying drawings.

BRIEF DESCRIPTION OF THE DRAWINGS

FIG. 3(*b*) shows the waveform diagram of the ignition signal generated by a signal coil during the forward rotation of the engine;

FIG. 3(*c*) shows the waveform diagram of the alternating output current generated by the generator coil during the reverse rotation of the engine; and FIG. 3(*d*) shows the waveform diagram of the ignition signal generated by the signal coil during the reverse rotation of the engine.

DESCRIPTION OF THE PREFERRED EMBODIMENT

The present invention will now be described in detail with reference to a presently preferred embodiment thereof as illustrated in the accompanying drawings.

Figure 1:
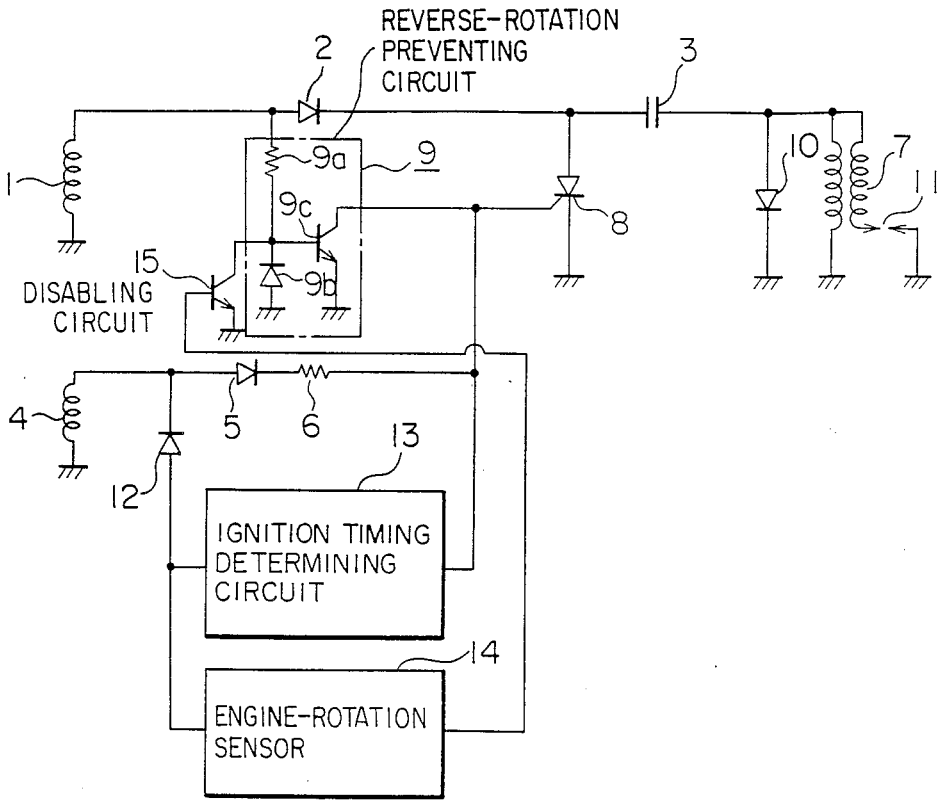
FIG. 1 is a circuit diagram of an ignition system for an engine according to the present invention.
Figures 3A, 3B, 3C, 3D:
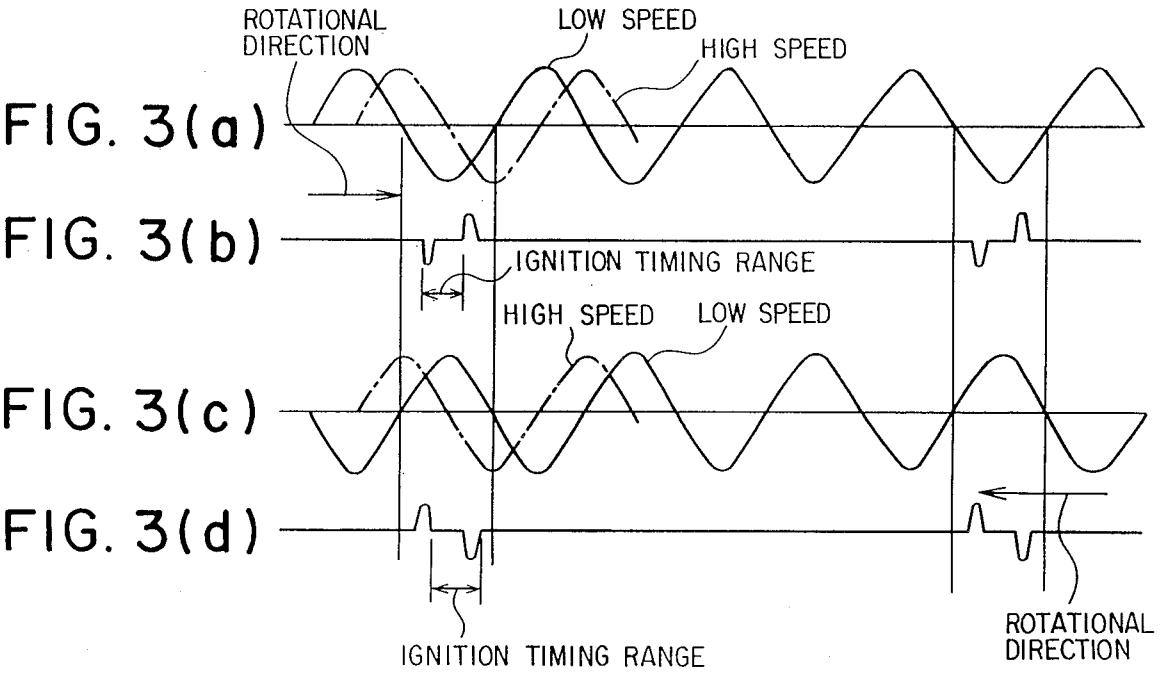
FIGS. 3(*a*) shows the waveform diagram of the alternating output current of a generator coil.

Referring first to FIG. 1, there is shown an ignition system for an engine which includes, in addition to the elements 1 through 13 which are the same as those employed in the conventional ignition system illustrated in FIG. 3, an engine-rotation sensing circuit 14 for sensing the number of revolutions per minute of the engine, and a disabling circuit 15 in the form of a transistor for disabling the reverse-rotation preventing circuit 9 when the number of revolutions per minute of the engine as sensed by the engine-rotation sensing circuit 14 exceeds a certain predetermined level. The engine-rotation sensing circuit 14 is constructed such that it produces a low-level output at the output terminal thereof when the engine rotates at low speeds, i.e., the number of revolutions per minute of the engine is below the certain predetermined level, whereas it produces a high-level output at the output terminal thereof when the number of revolutions per minute of the engine exceeds the predetermined level. Such an engine-rotation sensing circuit 14 is well known in the art and one example thereof is disclosed in Japanese Patent Laid-Open No. 56-107,964. The engine-rotation sensing circuit 14 is coupled at its input terminal to the signal coil 4 through the diode 12 and at output terminal to the base of the transistor 15. The transistor 15 has its collector coupled to a conductor connecting the resistor 9*c* and the diode 9*b* of the reverse-rotation preventing circuit 9, and its emitter grounded.

Figure 2:
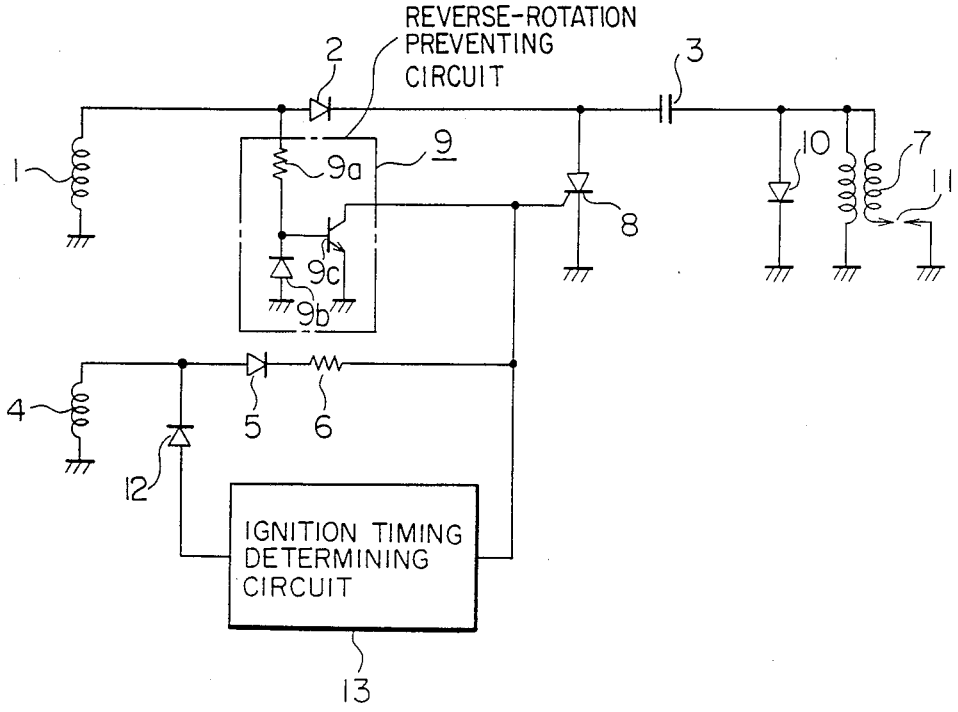
FIG. 2 PRIOR ART
FIG. 2 is a circuit diagram of a conventional ignition system for an engine.

With the circuit arrangement as described above, when the engine rotates at low speeds, i.e., the number of revolutions per minute of the engine is below the predetermined level, the engine-rotation sensing circuit 14 produces a low-level output so that the transistor 15 is non-conductive. As a result the entire ingnition system operates in the same manner as described before the reference to the conventional ignition system of FIG. 2.

On the other hand, in cases where the engine rotates at high speeds, the engine-rotation sensing circuit 14 provides a high-level output when the number of revolutions per minute of the engine exceeds the predetermined level so that the transistor 15 is made conductive, thus disabling the output of the reverse-rotation preventing circuit 9. Specifically, in this state, even if the alternating current generated by the generator coil 1 has the positive polarity, it is shunted to flow from the generator coil 1 through the now conductive transistor 15 to ground, holding the transistor 9c non-conductive. As a result, the thyrister 8 is controlled to be made conductive whenever the ignition timing control circuit 13 provides an ignition timing control signal, so that the capacitor 3 discharges through the now conductive thyrister 8 and the primary side of the ignition coil 7. Thus, a high voltage is developed at the secondary side of the ignition coil 7 to cause the spark plug 11 to generate a spark whereby the engine is able to operate.

What is claimed is:

1. An ignition system for an engine with a reverse-rotation preventing function, said ignition system comprising:

a generator coil for generating an alternating current output in synchronism with the rotation of the engine;

an ignition circuit connected to receive the alternating current output of said generator coil for producing a high voltage for ignition;

a reverse-rotation preventing circuit operable in response to the output of a predetermined polarity of said generator coil to prevent the operation of said ignition circuit as long as the predetermined polarity of the generator output remains unchanged;

an engine-rotation sensing circuit for sensing the number of revolutions per minute of the engine; and a disabling circuit for disabling said reverse-rotation preventing circuit when the number of revolutions per minute of the engine as sensed by said engine-rotation sensing circuit exceeds a predetermined level.

2. the ignition system according to claim 1, wherein said disabling circuit comprises a transistor which has its based coupled to said engine-rotation sensing circuit, its collector coupled to said reverse-rotation preventing circuit and its emitter grounded.

3. The ignition system according to claim 2, wherein said engine-rotation sensing circuit has an input terminal coupled through a diode to a signal coil and an output terminal coupled to the base of said transistor.

4. The ignition system according to claim 2, wherein said reverse-rotation preventing circuit comprises a transistor which has a base coupled through a resistor to said generator coil and grounded through a diode, a collector coupled to said ignition circuit, and an emitter grounded, the collector of said transistor of said disabling circuit being coupled to a conductor connecting said resistor and said diode.

5. The ignition system according to claim 4, wherein said ignition circuit comprises:

a capacitor having an input terminal coupled through a rectifier diode to said generator coil and an output terminal;

a thyrister having an anode coupled to an conductor connecting said rectifier diode and the input terminal of said capacitor, a grounded cathode and a switching gate commonly coupled to the collector of said transistor of said reverse-rotation preventing circuit, to said ignition timing determining circuit and to a signal coil through a resistor and a diode;

an ignition coil having a primary side coupled to the output terminal of said capacitor and a secondary side;

a diode having an anode coupled to a conductor connecting said capacitor and the primary side of said ignition coil and a grounded cathode; and a spark plug coupled between the secondary side of said ignition coil and ground.

* * * * *